US006471366B1

(12) United States Patent
Hughson et al.

(10) Patent No.: US 6,471,366 B1
(45) Date of Patent: Oct. 29, 2002

(54) DEPTH-COMPENSATED UNDERWATER LIGHT

(75) Inventors: Wes Hughson, Panama City Beach; Bill Olstad, Panama City, both of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/917,592

(22) Filed: Jul. 30, 2001

(51) Int. Cl.[7] ..... F21V 33/00

(52) U.S. Cl. ..... 362/101; 362/158; 362/204; 362/205; 362/267

(58) Field of Search ..... 362/101, 158, 362/202, 203, 204, 205, 206, 267, 198, 189

(56) References Cited

U.S. PATENT DOCUMENTS 5,158,356 A * 10/1992 Guthrie ..... 362/188
6,065,848 A * 5/2000 Tucker et al. ..... 362/101
6,158,873 A * 12/2000 Griffiths ..... 362/158
6,241,359 B1 * 6/2001 Lin ..... 362/96
6,336,732 B1 * 1/2002 Shiau ..... 362/205

* cited by examiner

*Primary Examiner*—Sandra O'Shea
*Assistant Examiner*—Ronald E. DelGizzi
(74) *Attorney, Agent, or Firm*—Harvey A. Gilbert; Donald G. Peck

(57) ABSTRACT

An underwater light includes a sealed housing defined by a rigid portion and a flexible portion. The rigid portion incorporates a light transmission window. A light source is mounted in the housing to direct its light through the housing's window. Also mounted in the housing are a power source and an open electrical circuit coupling the power source to the light source. The open electrical circuit includes spaced-apart terminals that prevent electrical power from being delivered to the light source. One of the terminals is coupled to the flexible portion of the housing and is aligned with another of terminals. Flexing of the housing's flexible portion into the housing causes the terminals to contact one another so that electrical power can be delivered to the light source. For depth compensation, a non-compressible dielectric fluid fills the housing.

16 Claims, 1 Drawing Sheet

DEPTH-COMPENSATED UNDERWATER LIGHT

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to self-contained lights, and more particularly to a depth-compensated underwater light that can be made from non-magnetic components if necessary.

BACKGROUND OF THE INVENTION

Underwater divers frequently need to check display readings on a variety of equipment such as the diver's underwater breathing apparatus or sensors being carried by the diver. In low-light conditions, these displays can be difficult or impossible to read. Accordingly, the ability to illuminate the display becomes a requirement. Currently, divers use chemical lights that illuminate when mechanically manipulated to allow chemicals contained therein to mix/react to generate luminescence. These lights are continuously "on" once activated. However, in many military applications such as mine clearing operations, lighting of the display must be brief in order to minimize the chance of detection from the water's surface. Further, since mine clearing operations could be compromised by the presence of magnetic material, all equipment carried by the diver should present little or no magnetic signature.

SUMMARY OF THE INVENTION

Accordingly, it is an object of the present invention to provide light for use in underwater applications.

Another object of the present invention is to provide underwater light constructed for depth compensation.

Still another object of the present invention is to provide an underwater light having little or no magnetic signature.

Yet another object of the present invention is to provide an underwater light that can be turned on and off easily.

Other objects and advantages of the present invention will become more obvious hereinafter in the specification and drawings.

In accordance with the present invention, an underwater light includes a sealed housing defined by a rigid portion and a flexible portion. The rigid portion incorporates a window for permitting the passage of light therethrough. A light source is mounted in the housing to direct light generated thereby through the housing's window. A power source is also mounted in the housing. An open electrical circuit couples the power source to the light source. The open electrical circuit includes spaced-apart terminals that prevent electrical power generated by the power source from being delivered to the light source. One of the terminals is coupled to the flexible portion of the housing and is aligned with another of terminals. Flexing of the housing's flexible portion into the housing causes the terminals to contact one another so that electrical power can be delivered to the light source. For depth compensation, a non-compressible dielectric fluid fills the housing.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
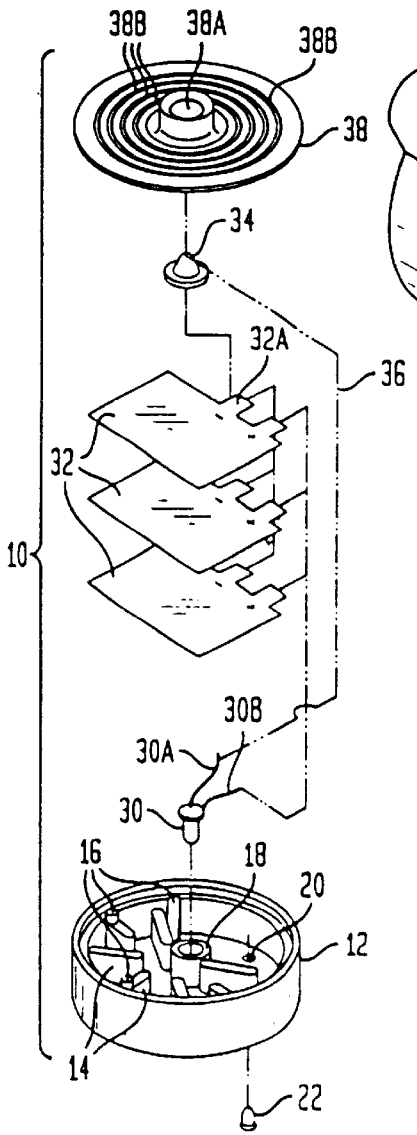
FIG. 1 is an exploded perspective view of the components in one embodiment of the underwater depth-compensated light in accordance with the present invention.

Referring now to the drawings, and more particularly to FIG. 1, an exploded view of one embodiment of an underwater depth-compensated light according to the present invention is shown and referenced generally by numeral 10. Underwater light 10 will be described for its use in conjunction with the U.S. Navy's Mk16 underwater breathing apparatus (UBA) which will be described briefly using FIGS. 2A and 2B. However, it is to be understood that the underlying principles of the light described herein can be applied in a variety of embodiments without departing from the scope of the present invention.

Figure 2A:
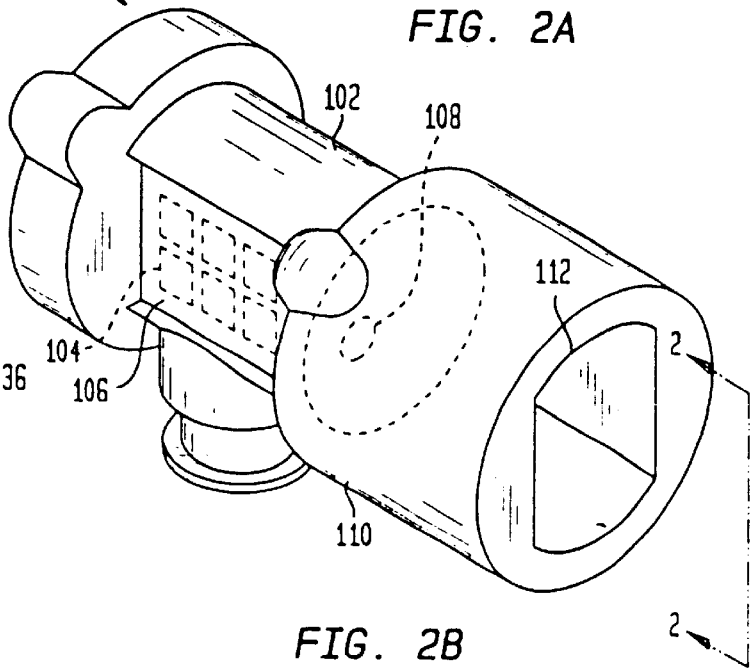
FIG. 2A is a perspective view of the display assembly used by U.S. Navy's Mk16 underwater breathing apparatus.
Figure 2B:
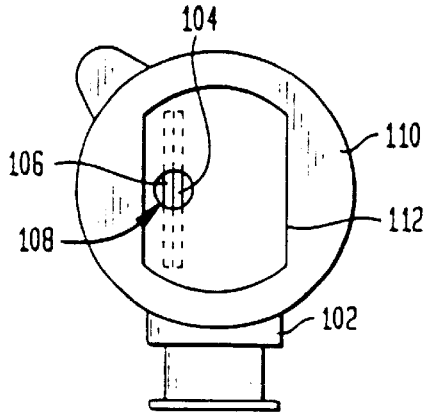
FIG. 2B is a side view of the display assembly taken along line 2—2 in FIG. 2A.

In FIGS. 2A and 2B, a display assembly used by the Mkl6 UBA is shown in perspective (FIG. 2A) and side (FIG. 2B) views, and is referenced generally by numeral 100. In relevant portion, display assembly 100 includes a housing 102 supporting a display screen 104 protected by a display glass 106. To provide for the illumination of display 104, a hole 108 is formed in the side of housing 102 to provide access to display screen 104 and display glass 106 as best illustrated in FIG. 2B. A rubber boot 110 (used to previously house a now obsolete piece of equipment) is coupled to housing 102. An opening 112 is formed in boot 110 to receive underwater light 10 therein where the light generated thereby is focused through hole 108 to illuminate display screen 104.

Figure 3:
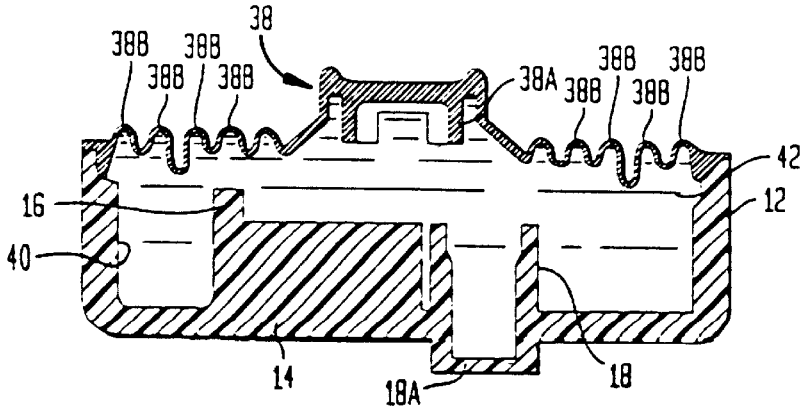
FIG. 3 is a side cross-sectional view illustrating only the present invention's rigid housing and flexible lid sealed together to illustrate the void formed therebetween.

Reference will now be made to FIGS. 1 and 3 simultaneously where FIG. 3 illustrates only the outer structure of light 10. Underwater light 10 includes an open, cylindrical rigid support housing 12 having therein a plurality of mounting ribs 14 and locating pegs 16 for supporting the mounting of components thereon as would be well understood in the art. The particular design of the mounting assembly defined by ribs 14 and pegs 16 is merely representative and is not to be considered a limitation of the present invention. In the illustrated embodiment, housing 12 is sized/shaped for a compression fit with opening 112 in boot 110 so that light 10 and boot 110 are sealed to one another.

Housing 12 further defines a light mounting 18 for receiving therein a light 30 such as an LED. Light mounting 18 serves as a mechanical locator and attachment point for light 30. As best seen in FIG. 3, light mounting 18 terminates in a transparent window or lens 18A through which light can be transmitted. Light mounting 18 and window 18A are positioned for correspondence with hole 108 in housing 102. Window 18A can be sized to fit into hole 108 and, therefore, can be made to extend axially from housing 12. A fill hole 20 is provided in housing 12 to permit the filling of underwater light 10 with a non-compressible fluid 42 as will be explained further below. Once filled, hole 20 is sealed with a plug 22.

Light 30 has its leads 30A and 30B electrically coupled to an open circuit arrangement defined by one or more batteries 32 (e.g., "credit card" type lithium batteries), an electrical contact 34 and leads electrically linking light 30, batteries 32 and contact 34 as shown by dashed lines 36. Note that if lithium batteries are used, a high-ohm resistor (not shown) can be placed across the battery terminals to prevent development of a passivation layer on the batteries as is known in the art. Contact 34 is securely mounted in a receptacle 38A formed in a flexible lid 38.

During assembly, light 30, batteries 32 and contact 34 are electrically coupled by leads 30A and 30B as described above. Light 30 and batteries 32 are mounted in housing 12 and contact 34 is mounted in receptacle 38A. Housing 12 and flexible lid 38 are sealed to one another (e.g., bonded, welded, fused, etc.) at their respective outer peripheries to form an internal void 40 (illustrated in FIG. 3) housing the components described above. Void 40 is then filled with a non-compressible dielectric fluid 42 via fill hole 20, and hole 20 is sealed by plug 22. Flexible lid 38 is constructed with receptacle 38A positioned such that contact 34 and one negative terminal 32A of one of batteries 32 are maintained in a spaced-apart relationship after light 10 is assembled thereby essentially defining terminals of an open electrical circuit.

Flexible lid 38 forms a flexible diaphragm sealed to housing 12 and forms the activating "button" for underwater light 10. That is, from an electrical perspective, when a force is applied to flexible lid 38 such that it is pressed/flexed into void 40 until contact 34 touches terminal 32A, a closed electrical circuit is formed so that power from batteries 32 is supplied to light 30. When the force is removed, flexible lid 38 returns to its at rest condition to thereby define an open circuit once again. Thus, underwater light 10 is only on when flexible lid 38 is pressed/flexed into void 40.

Since underwater light 10 will be subject to depth pressures, pressure compensation is required to prevent flexible lid 38 from flexing into void 40 (and activating light 30) as depth pressure increases. Accordingly, as described above, void 40 is filled with non-compressible dielectric fluid 42 (via fill hole 20) after all electrical components are mounted therein and flexible lid 38 is sealed to housing 12. Such non-compressible fluids are known in the art and could include, for example, silicone-based gels or oils and synthetic transformer oils.

The volume of underwater light 10 cannot change when flexible lid 38 is pressed into void 40. Since housing 12 is rigid, flexible lid 38 must flex to allow non-compressible fluid 42 to redistribute itself when light 10 is activated. To facilitate volume redistribution of fluid 42, flexible lid 38 can incorporate a plurality of concentric ridges 38B.

As mentioned above, light mounting 18 in housing 12 incorporates a transparent window 18A. While this could be a separate component, housing 12 could also be made entirely from a transparent plastic thereby integrating window 18A directly into housing 12. If constructed in this fashion, it would be preferable to construct flexible lid 38 to be optically opaque to prevent light (generated by light 30) transmission back through flexible lid 38.

Although housing 12 is rigid and lid 38 is flexible, they can be made from the same material to facilitate the seal that must be formed therebetween during construction as like materials are more easily joined to one another. Rigidness/flexibility of housing 12 and lid 38 can be adjusted by the thickness thereof and/or the use of flexibility enhancing structure such as concentric ridges 38B. Typically, housing 12 and lid 38 are made from a plastic material having high elongation and low tensile strength.

If underwater light 10 is to present little or no magnetic signature, all components thereof should be substantially non-magnetic. For example, housing 12 and lid 38 can be plastic. Batteries 32 can be lithium batteries. Contact 34 can be made from brass. Light 30 and electrical leads 36 can all be selected to have little or no magnetic signatures. In this way, underwater light 10 can be safely used in mine clearing operations or around any equipment (e.g., a compass) that would be affected by the presence of a magnetic signature.

The advantages of the present invention are numerous. An underwater light of simple construction and operation will provide a diver with light on demand. Since the light is only activated when needed, its life will be extended as it cannot remain activated inadvertently. The light is pressure compensated so that it will be unaffected by increasing/decreasing depth pressure. Further, in illustrated embodiment, the present invention will find immediate utility with the display on the U.S. Navy's Mk16 UBA.

Although the invention has been described relative to a specific embodiment thereof, there are numerous variations and modifications that will be readily apparent to those skilled in the art in light of the above teachings. For example, the particular light, power source and/or arrangement for the open electrical circuit coupling the light and power source, are not limited to the illustrated embodiment. More or less batteries, or different types thereof, could be used as required. The rigid housing and flexible lid could be constructed other than as shown and in different shapes to suit a particular application. For example, either the rigid housing or flexible lid could be formed as a hand-held body. In the former case, the flexible lid would be formed as a depressible button whereas in the latter case the flexible lid could be squeezed by one's hand. It is therefore to be understood that, within the scope of the appended claims, the invention may be practiced other than as specifically described.

What is claimed as new and desired to be secured by Letters Patent of the United States is:

1. An underwater light comprising:

a sealed housing defined by a rigid portion and a flexible portion, said rigid portion incorporating a window for permitting the passage of light therethrough;

a light source mounted in said housing for directing light generated thereby through said window;

a power source mounted in said housing for generating electrical power;

an open electrical circuit coupling said power source to said light source, said open electrical circuit including spaced-apart terminals for preventing said electrical power from being delivered to said light source;

one of said terminals coupled to said flexible portion of said housing and aligned with another of said terminals, wherein flexing of said flexible portion into said housing causes said terminals to contact one another wherein said electrical power is delivered to said light source; and a non-compressible dielectric fluid filling said housing.

2. An underwater light as in claim 1 wherein said housing, said light source, said power source, said open electrical circuit and said dielectric fluid comprise substantially non-magnetic materials.

3. An underwater light as in claim 1 wherein said power source comprises at least one lithium battery.

4. An underwater light as in claim 1 wherein said rigid portion is transparent with respect to transmission of light and said flexible portion is opaque with respect to transmission of light.

5. An underwater light as in claim 1 wherein said flexible portion has concentric ridges formed therein.

6. An underwater light comprising:

a rigid housing incorporating a window for permitting the passage of light therethrough;

a flexible diaphragm sealably mounted to said rigid housing to define a void therebetween;

a light source mounted in said void for directing light generated thereby through said window;

a power source mounted in said void for generating electrical power;

an open electrical circuit mounted in said void and coupling said power source to said light source, said open electrical circuit including spaced-apart terminals for preventing said electrical power from being delivered to said light source;

one of said terminals coupled to said flexible diaphragm and aligned with another of said terminals, wherein flexing of said flexible diaphragm into said void causes said terminals to contact one another wherein said electrical power is delivered to said light source; and a non-compressible dielectric fluid filling said void.

7. An underwater light as in claim 6 wherein said rigid housing, said flexible diaphragm, said light source, said power source, said open electrical circuit and said dielectric fluid comprise substantially non-magnetic materials.

8. An underwater light as in claim 6 wherein said power source comprises at least one lithium battery.

9. An underwater light as in claim 6 wherein said rigid housing is transparent with respect to transmission of light and said flexible diaphragm is opaque with respect to transmission of light.

10. An underwater light as in claim 6 wherein said flexible diaphragm is a circular diaphragm having concentric ridges formed therein.

11. An underwater light as in claim 6 wherein said rigid housing and said flexible diaphragm are made from the same material.

12. An underwater light for mounting in an opening of a flexible housing, comprising:

a transparent cylindrical rigid housing for permitting the passage of light therethrough, said rigid housing sized for a compression fit in said opening of said flexible housing;

an opaque flexible diaphragm sealed to said rigid housing to define a void therebetween;

a light source mounted to said rigid housing and in said void for directing light generated thereby through said rigid housing;

a power source mounted to said rigid housing and in said void for generating electrical power;

an open electrical circuit mounted in said void and coupling said power source to said light source, said open electrical circuit including spaced-apart terminals for preventing said electrical power from being delivered to said light source;

one of said terminals coupled to said flexible diaphragm and aligned with another of said terminals, wherein flexing of said flexible diaphragm into said void causes said terminals to contact one another wherein said electrical power is delivered to said light source; and a non-compressible dielectric fluid filling said void.

13. An underwater light as in claim 12 wherein said rigid housing, said flexible diaphragm, said light source, said power source, said open electrical circuit and said dielectric fluid comprise substantially non-magnetic materials.

14. An underwater light as in claim 12 wherein said power source comprises at least one lithium battery.

15. An underwater light as in claim 12 wherein said flexible diaphragm is a circular diaphragm having concentric ridges formed therein.

16. An underwater light as in claim 12 wherein said rigid housing and said flexible diaphragm are made from the same material.

* * * * *